US010945487B2

(12) United States Patent
Lam et al.

(10) Patent No.: US 10,945,487 B2
(45) Date of Patent: Mar. 16, 2021

(54) ELECTROSTATIC DISCHARGE SHOE AND SURFACE EVALUATION

(71) Applicant: International Business Machines Corporation, Armonk, NY (US)

(72) Inventors: Ho-Yiu Lam, Mountain View, CA (US); John Thomas Kinnear, Jr., LaGrangeville, NY (US); Sia Kai Julian Tan, Tampines St (SG)

(73) Assignee: International Business Machines Corporation, Armonk, NY (US)

( * ) Notice: Subject to any disclaimer, the term of this patent is extended or adjusted under 35 U.S.C. 154(b) by 275 days.

(21) Appl. No.: 16/058,001

(22) Filed: Aug. 8, 2018

(65) Prior Publication Data

US 2020/0046065 A1 Feb. 13, 2020

(51) Int. Cl.

| | |
|---|---|
| ***A43B 7/36*** | (2006.01) |
| ***E04F 15/02*** | (2006.01) |
| ***A43B 13/14*** | (2006.01) |
| ***A43B 3/00*** | (2006.01) |

(52) U.S. Cl.

CPC ..... *A43B 7/36* (2013.01); *A43B 3/0005* (2013.01); *A43B 13/14* (2013.01); *E04F 15/02177* (2013.01)

(58) Field of Classification Search

CPC ..... A43B 7/36; A43B 31/26; E04F 2290/048; A61B 5/6807

See application file for complete search history.

(56) References Cited

U.S. PATENT DOCUMENTS 5,519,384 A * 5/1996 Chanudet ..... G01R 31/50 340/649

6,078,875 A 6/2000 Jubin et al.

(Continued)

FOREIGN PATENT DOCUMENTS

WO WO-02076256 A1 * 10/2002 ..... A43B 7/36

OTHER PUBLICATIONS

Mell et al., "The NIST Definition of Cloud Computing", National Institute of Standards and Technology, U.S. Dept. of Commerce, NIST Special Publ. 800-145, Sep. 2011, 7 pages.

(Continued)

*Primary Examiner* — Matthew G Marini

(74) *Attorney, Agent, or Firm* — Heslin Rothenberg Farley & Mesiti P.C.; Tihon Poltavets, Esq.

(57) ABSTRACT

A method, computer program product, and a system where a processor(s), in a computing environment comprised of multiple containers comprising modules, includes a processor(s) continuously obtaining pressure data from pressure sensors embedded in electrostatic dissipative (ESD) footwear. The processor(s) determines that the obtained pressure data indicates a pressure level of a pre-determined threshold and the given threshold is sustained for a pre-determined interval of time in some of the items. The processor(s) accesses one or more voltage sensors embedded in each item of the items and obtains voltage data by utilizing an ESD floor that the items are in contact with as a ground reference. The processor(s) validates functionality of some of the items and functionality of the ESD floor, based on monitoring the voltage data from the one or more voltage sensors.

20 Claims, 6 Drawing Sheets

(56) References Cited

U.S. PATENT DOCUMENTS

| | | | | |
|---|---|---|---|---|
| 7,671,599 | B1 * | 3/2010 | Tan | A43B 7/36 324/452 |
| 2012/0283971 | A1 | 11/2012 | Anderson et al. | |
| 2017/0127749 | A1 * | 5/2017 | Boeck | A61B 5/1036 |
| 2017/0146579 | A1 | 5/2017 | Beaty et al. | |

OTHER PUBLICATIONS

Fowler et al., Procedures for the Design, Analysis and Auditing of Static Control Flooring/Footwear Systems, ESD Journal.

* cited by examiner

ELECTROSTATIC DISCHARGE SHOE AND SURFACE EVALUATION

BACKGROUND

An electrostatic discharge is a sudden flow of electricity between two electrically charged objects, caused by contact, an electrical short, and/or dielectric breakdown. The electrostatic discharge occurs when differently-charged objects are brought close together or when the dielectric between them breaks down, often creating a visible spark. Certain devices, referred to as electrostatic-sensitive devices, are particularly susceptible or sensitive to electrostatic discharges. An electrostatic-sensitive device is any component (primarily electrical) which can be damaged by common static charges which build up on people, tools, and other non-conductors or semiconductors.

To preserve the functionality and operability of electrostatic-sensitive devices, in the electronic industry locations which produce electrostatic-sensitive devices, certain precautions are taken to avoid exposing electrostatic-sensitive devices to static charges. Two elements that are commonly utilized in these environments are: 1) electrostatic dissipative shoes (ESD) shoes, which ensure products are not being damaged by charges accumulated on a human body through tribocharging (i.e., a contact electrification process that enables buildup of static electricity due to touching or rubbing of surfaces in specific combinations of two dissimilar materials); and 2) electrostatic dissipative (ESD) flooring, to work with the ESD shoes to provide an effective static discharge path to ground. These two elements work together and should one fail, the electrostatic-sensitive devices in production are placed at risk. Because the acronym "ESD" can be utilized as an acronym for many different terms utilized herein, ESD will be utilized exclusively herein to refer to electrostatic dissipative items, such as ESD shoes and ESD flooring.

In existing ESD production environments, ESD shoes and ESD flooring are managed and maintained separately. While one system measures flooring conductivity to ground, periodically, at selected areas, to ensure standard conductivity has been met, a separate system measures conductivity to ground by testing ESD shoes at an entrance of a production floor, daily. Maintaining these two separate systems (or mechanisms) represents a significant cost to the electrostatic-sensitive device producer.

SUMMARY

Shortcomings of the prior art are overcome and additional advantages are provided through the provision of a method for validating performance of electrostatic dissipative footwear and an electrostatic dissipative floor. The method includes, for instance: continuously obtaining, by one or more processors, pressure data from one or more pressure sensors embedded in one or more items of electrostatic dissipative (ESD) footwear, the one or more items of ESD footwear each comprising a sole; determining, by the one or more processors, that the obtained pressure data indicates a pressure level of a pre-determined threshold and the given threshold is sustained for a pre-determined interval of time in a portion of items of the one or more items; based on the determining, accessing, by the one or more processors, one or more voltage sensors embedded in each item of the portion of items and obtaining voltage data from the one or more voltage sensors, wherein the obtaining comprises utilizing an ESD floor as a ground reference, and wherein one or more soles of the portion of the items are in contact with the ESD floor during the obtaining; and validating, by the one or more processors, functionality of the portion of the items and functionality of the ESD floor, based on monitoring the voltage data from the one or more voltage sensors.

Shortcomings of the prior art are overcome and additional advantages are provided through the provision of a computer program product for validating performance of electrostatic dissipative footwear and an electrostatic dissipative floor. The computer program product comprises a storage medium readable by a processing circuit and storing instructions for execution by the processing circuit for performing a method. The method includes, for instance: continuously obtaining, by one or more processors, pressure data from one or more pressure sensors embedded in one or more items of electrostatic dissipative (ESD) footwear, the one or more items of ESD footwear each comprising a sole; determining, by the one or more processors, that the obtained pressure data indicates a pressure level of a pre-determined threshold and the given threshold is sustained for a pre-determined interval of time in a portion of items of the one or more items; based on the determining, accessing, by the one or more processors, one or more voltage sensors embedded in each item of the portion of items and obtaining voltage data from the one or more voltage sensors, wherein the obtaining comprises utilizing an ESD floor as a ground reference, and wherein one or more soles of the portion of the items are in contact with the ESD floor during the obtaining; and validating, by the one or more processors, functionality of the portion of the items and functionality of the ESD floor, based on monitoring the voltage data from the one or more voltage sensors.

Methods and systems relating to one or more aspects are also described and claimed herein. Further, services relating to one or more aspects are also described and may be claimed herein.

Additional features are realized through the techniques described herein. Other embodiments and aspects are described in detail herein and are considered a part of the claimed aspects.

BRIEF DESCRIPTION OF THE DRAWINGS

One or more aspects are particularly pointed out and distinctly claimed as examples in the claims at the conclusion of the specification. The foregoing and objects, features, and advantages of one or more aspects are apparent from the following detailed description taken in conjunction with the accompanying drawings in which:

DETAILED DESCRIPTION

Figure 1:
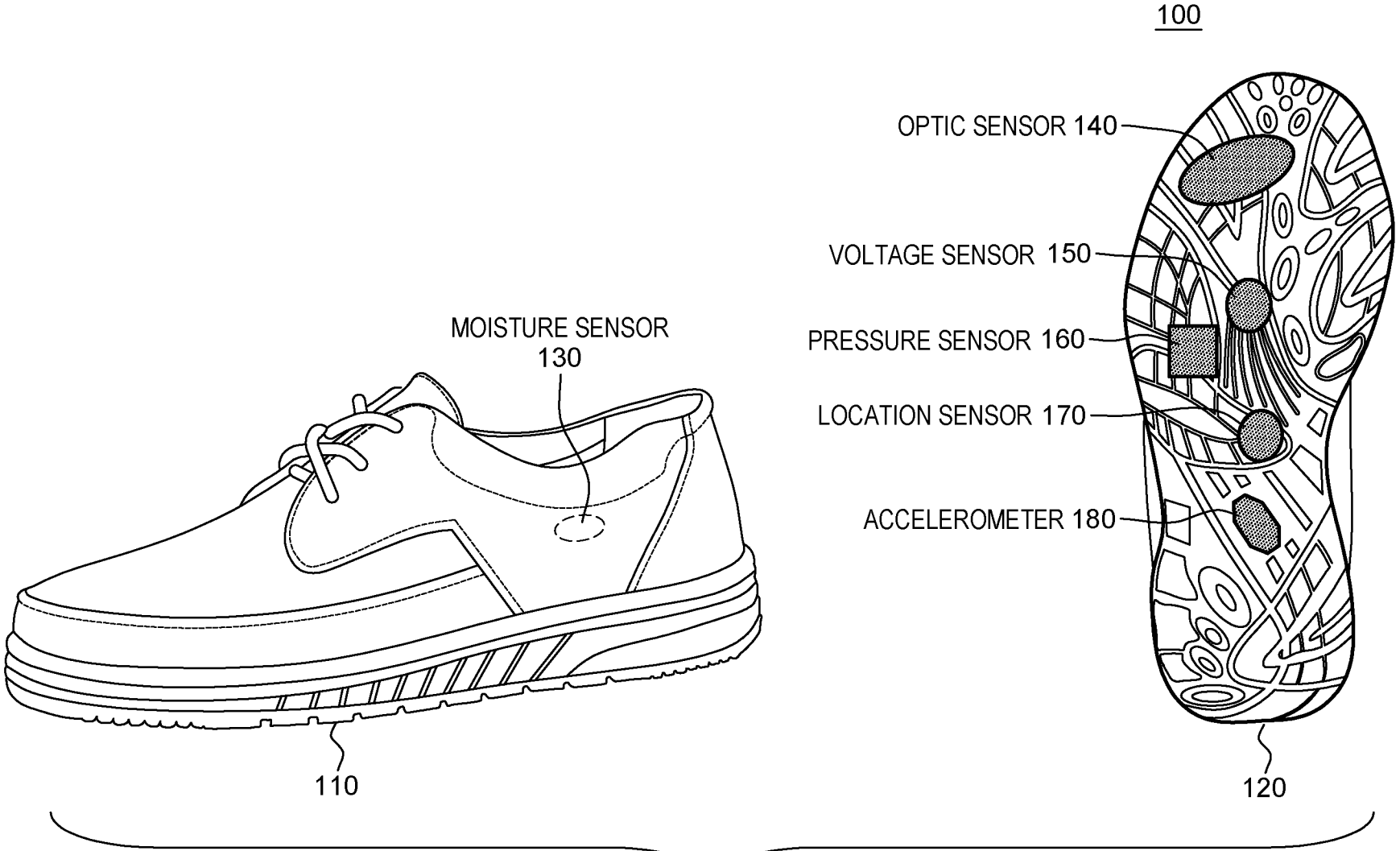
FIG. 1 is an illustration of various aspects of some embodiments of the present invention may be implemented.

The accompanying figures, in which like reference numerals refer to identical or functionally similar elements throughout the separate views and which are incorporated in and form a part of the specification, further illustrate the present invention and, together with the detailed description of the invention, serve to explain the principles of the present invention. As understood by one of skill in the art, the accompanying figures are provided for ease of understanding and illustrate aspects of certain embodiments of the present invention. The invention is not limited to the embodiments depicted in the figures.

Figure 4:
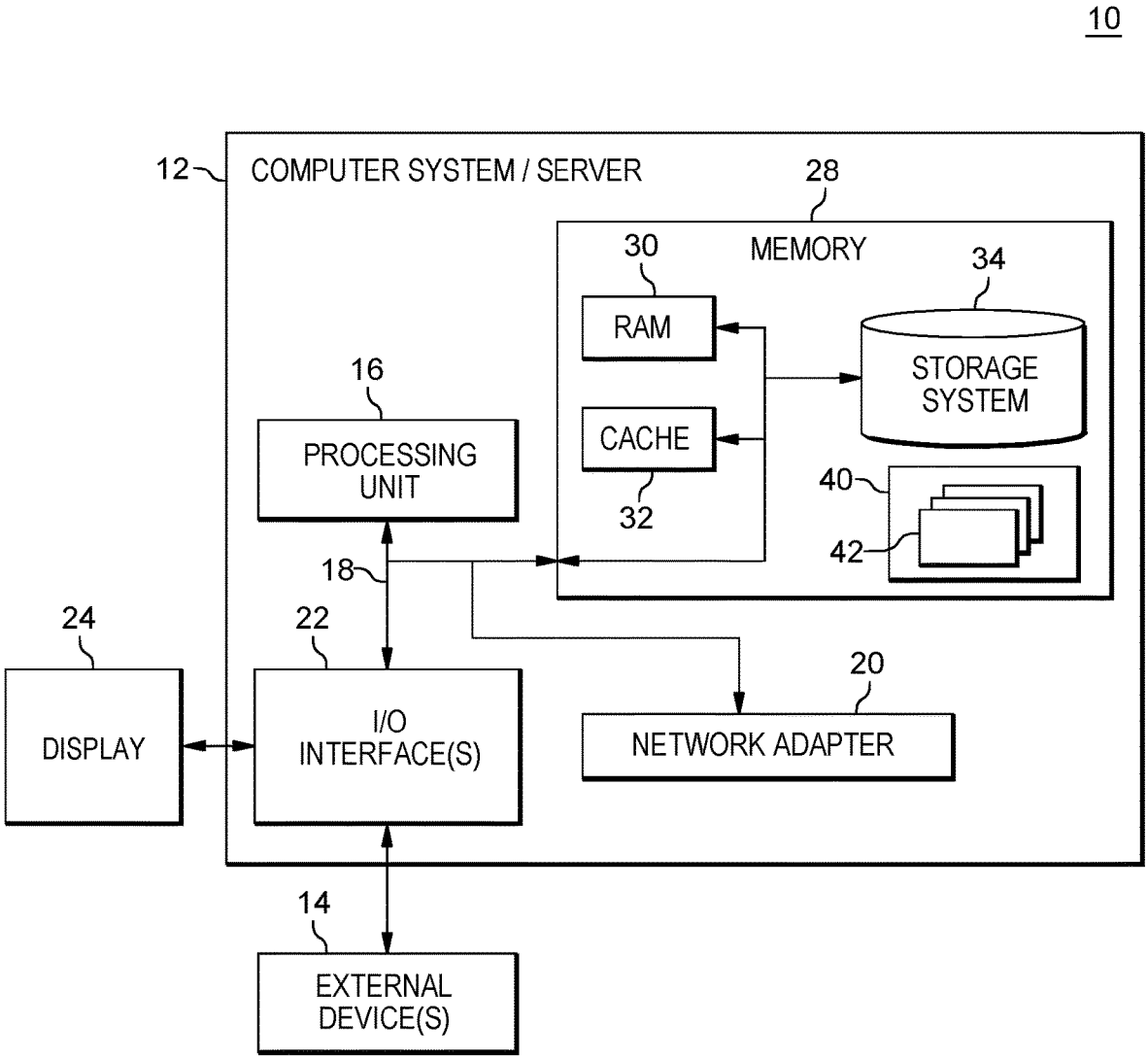
FIG. 4 depicts one embodiment of a computing node that can be utilized in a cloud computing environment.

As understood by one of skill in the art, program code, as referred to throughout this application, includes both software and hardware. For example, program code in certain embodiments of the present invention includes fixed function hardware, while other embodiments utilized a software-based implementation of the functionality described. Certain embodiments combine both types of program code. One example of program code, also referred to as one or more programs, is depicted in FIG. 4 as program/utility 40, having a set (at least one) of program modules 42, may be stored in memory 28.

Embodiments of the present invention include a computer-implemented method, a computer program product, and a computer system that include program code executed on at least one processing circuit that monitors ESD footwear and flooring systems by utilizing embedded sensors on the ESD footwear. In some embodiments of the present invention, program code executing on at least one processing device determines that an item of ESD footwear is being utilized, based on obtaining an indication from an embedded sensor on the item that the embedded sensor is experiencing pressure at a pre-determined pressure threshold. Based on determining that the item is being utilized, the program code obtains voltage data, via the embedded sensor. Based on the voltage data, the program code predicts a future failure of the item. The program code makes this determination based on the voltage data because the voltage increases due to wear on the item or the accumulation of debris on the item. Based on predicting that a failure will occur within a given interval, the program code alerts a wearer to mitigate the perceived issue with the item by taking an action such as: 1) replacing the item; and/or 2) removing the accumulation of debris from the item. In some embodiments of the present invention, when the voltage data obtained by the program code indicates a rapid voltage increase, the program code identifies a location on an ESD floor (upon which the user wearing the item is standing) utilizing an embedded location sensor on the item. The program code notifies the wearer that flooring at the identified location should be replaced and/or rectified.

Embodiments of the present invention also include ESD footwear, which interacts with program code executing on at least one processing resource, to predict and identify functionality issues in the ESD footwear, as well as in portions of the ESD flooring, upon which a wearer of the ESD footwear is standing. As discussed above, the ESD footwear includes one or more embedded sensors to detect pressure and/or voltage, and one or more embedded location sensor. In addition, the ESD footwear can include an embedded optic sensor to detect dust levels on the ESD footwear, an embedded accelerometer to detect a type of foot motion of the ESD footwear (e.g., dragging of the ESD footwear against a surface, tribocharging, etc.), and/or a moisture sensor to detect damp floors. In some embodiments of the present invention, one or more of the sensors are embedded in the ESD footwear.

Aspects of various embodiments of the present invention are inextricably tied to computing and provide advantages over existing ESD footwear and flooring monitoring systems. Embodiments of the present invention are inextricably tied to computing because they utilize various electronic and computing components to determine the efficacy of ESD footwear and flooring, for the purpose of preserving electrostatic-sensitive devices in a facility where electrostatic-sensitive devices are present, including but not limited to, a production facility for the devices. Additionally, certain embodiments of the present invention include and/or utilize specialized hardware to provide the monitoring functionality. Aspects of some embodiments of the present invention provide advantages over existing monitoring approaches and components, including consolidating monitoring of both ESD shoes and ESD flooring, which combine to preserve electrostatic-sensitive devices, into a singular approach. Additionally, some existing approaches rely on utilizing specific testers which do not provide a continuous test (unlike embodiments of the present invention). One such tester can be connected to an automated system that can record the resistance of wrist straps or footwear systems, but cannot test the efficacy of an ESD floor. Another tester is a self-calibrating resistance tester that can reject a testing bypass. This self-calibrating resistance tester must be plugged into the ESD footwear or flooring in order to test resistance. In contrast to these test-based approaches, some embodiments of the present invention include program code that accesses embedded sensors in ESD footwear to track the voltage generation of the footwear/flooring system, continuously. Because embodiments of the present invention link a position of an ESD wearer on an ESD floor with the voltage on the body of the wearer, and the program code downloads this data, the program code can detect footwear or floor failures (or predicted failures) in real time, without the need for additional testing (like the aforementioned testers). The program code obtains the data from the sensors in the ESD footwear, utilizing a communications connection, such as a wireless network, and logs the data on a memory resource; the user need not plug the footwear or another part of the system into a tester. Another advantage of embodiments of the present invention is that testing and/or monitoring the efficacy of ESD footwear and flooring is accomplished while regular activity continues at a facility where electrostatic-sensitive devices are present. No pause in production is needed to validate the ESD footwear and flooring, unlike in existing testing approaches, where productivity is disturbed to connect a tester and gain and collect results.

FIG. 1 depicts an embodiment of an item 100 of ESD footwear that can be utilized in some embodiments of the present invention. FIG. 1 provides a first perspective 110 and a second perspective 120 of the item 100, in order to view various aspects from different angles. As will be discussed, the item 100 comprises various embedded sensors. These sensors communicate with program code executing on at least computing resource, via a wireless network connection, including but not limited to, the Internet. These sensors provide the program code with various data. As understood by one of skill in the art, sensors can be both active and passive. While passive sensors are polled by one or more programs in order to provide collected data, active sensors broadcast the data to the one or more programs. In various embodiments of the present invention, the sensors integrated into the item 100 can be both passive and/or active, including a combination of each. The particular design of the item 100 of footwear in FIG. 1 is offered merely as one non-limiting example. As understood by one of skill in the art, the various components can be integrated into footwear of a variety of styles.

For ease of illustration, the embodiment of the item 100 in FIG. 1 is shown to have one of each of various types of sensors. However, each sensor depicted may, in fact, be one or more of the sensors, in accordance with what is found most effective on the given embodiment of the item 100. Returning to FIG. 1, the item 100 depicted includes a moisture sensor 130 (to detect whether the ESD floor is damp, which would affect the efficacy of the floor, or to indicate that the user has very dry feet, which creates conductivity loss with the wearer's feet), an optic sensor 140 (to detect dust levels on the item 100 of ESD footwear), a voltage sensor 150 (to provide voltage data that is obtained by the program code, which enable the program code to predict a future failure of the item, based on the voltage data indicating a voltage above a given level, and/or to identify a failure in the ESD floor, based on the voltage data indicating a rapid voltage increase), a pressure sensor 160 (to provide an indication of pressure being applied to the program code, such that when the pressure is of, or above, a given threshold, optionally for a given amount of time, the program code determines that the item 100 is in use and proceeds to monitor the item 100 and the floor), a location sensor 170 (to provide location data describing a location of the wearer of the item 100 on the ESD floor contemporaneous with the program code determining that the voltage data indicates a rapid voltage increase), and an accelerometer 180 (to detect a type of foot motion of the wearer of the item 100, e.g., dragging of the ESD footwear against a surface, tribocharging, etc.).

Figure 2:
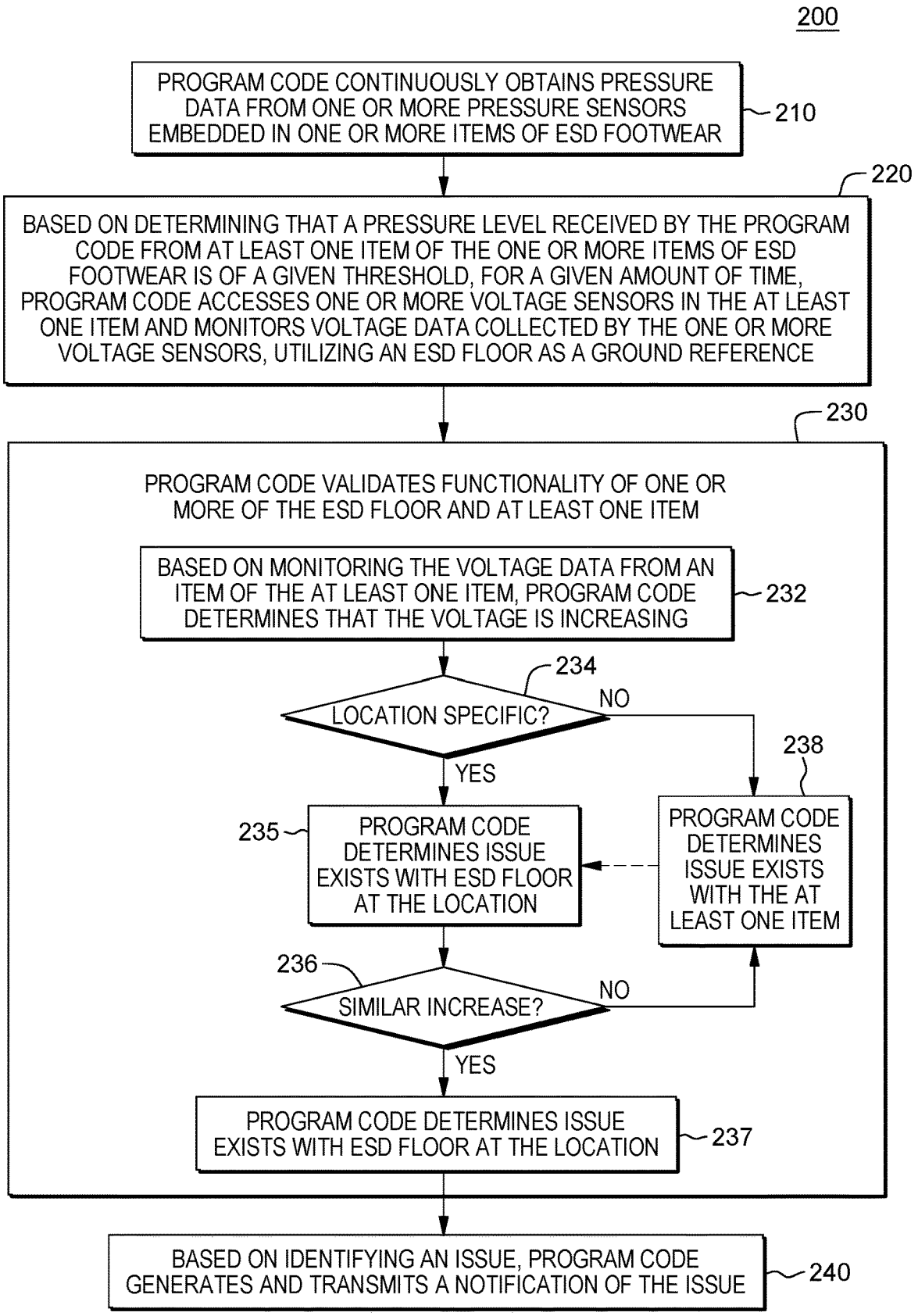
FIG. 2 is a workflow illustrating certain aspects of an embodiment of the present invention.

FIG. 2 is a workflow 200 that illustrates the utilization of the item 100 (FIG. 1) of FIG. 1 by one or more programs executing on at least one computing device to mitigate potential issues in the item 100 (an ESD shoe) and the ESD flooring upon which a wearer of the item 100 walks, including, but not limited to: 1) validating the ESD shoe(s) and conducting predictive analytics to determine when an ESD shoe will fail; 2) validating ESD flooring; and 3) validating a footwear/flooring system. To aid in illustrating the workflow 200, throughout the description of the aspects of FIG. 2, elements of FIG. 1 are referenced. FIG. 1 is merely one example of a possible item 100 of ESD footwear utilized, the item 100 comprising certain aspects of some embodiments of the present invention. The particular combination and configuration of components in the item 100 in FIG. 1 is not meant to suggest or impose any limitations, and is provided for illustrative purposes, only.

Referring to FIG. 2, in an embodiment of the present invention, program code continuously obtains pressure data from a pressure sensor 160 (FIG. 1) embedded in an item 100 (FIG. 1) of ESD footwear (210). Based on determining that a pressure level received by the program code is of a given threshold for a given amount of time, the program code accesses a voltage sensor 150 (FIG. 1) embedded in the item 100 (FIG. 1) and monitors voltage data collected by the voltage sensor 150 (FIG. 1) utilizing an ESD floor upon which the item 110 (FIG. 1) is placed as a ground reference (220). The program code begins to monitor the voltage after obtaining a consistent pressure reading of the threshold level (i.e., a certain threshold pressure level for a certain threshold duration of time). The consistent pressure reading of the threshold level indicates that the item 100 (FIG. 1) is in use (i.e., being worn by a wearer who is moving on the ESD floor). In some embodiments of the present invention, the pressure threshold is a configurable value and/or it may be pre-set to a default (e.g., foot pressure of 2 psi). Additionally, the duration of this consistent pressure level may also be configurable and/or may be a default (e.g., 5 seconds, 10 seconds, etc.). The pressure level and duration indicate to the program code that someone is wearing the item 100 (FIG. 1) and is standing still. In some embodiments of the present invention, accessing the voltage sensor 150 (FIG. 1) may include enabling the sensor. Leaving the voltage sensor 150 in an inactive state when the item 100 (FIG. 1) in not in use can serve to preserve the voltage sensor 150 (FIG. 1) and any power source (not pictured) utilized by the voltage sensor 150 (FIG. 1). In some embodiments of the present invention, a power source, such as a replaceable or rechargeable battery may be integrated into the items 100 (FIG. 1). Each sensor may comprise its own power source and/or certain of the sensors may share a single power source. In some embodiments of the present invention a kinetic energy recovery system and/or one or more micro generators can also be used as the source of power.

Based on monitoring voltage data collected by the voltage sensor (220), the program code validates functionality of one or more of the ESD floor and the item 110 (230). In some embodiments of the present invention, to validate the functionality of the item 100 (e.g., ESD shoes), based on monitoring the voltage data (via the voltage sensor 150), the program code determines that the voltage is increasing (232). In some embodiments of the present invention, the program code determines that the increase exceeds a given threshold. Based on determining that there has been an increase in voltage, the program code notifies the user (e.g., via email, text, warning light on the item 100, notification on personal computing device) that the item 100 should either be replaced or cleaned (240). The increase in voltage indicates an issue with the efficacy of the item 100, which is either that the shoe is becoming too worn to be effective or that the shoe is dirty; either circumstance may account for the increased voltage. In some embodiments of the present invention, the program code can tie the warning to a prediction of when the shoe should be maintained (e.g., either cleaned or replaced). Based on the increased voltage, the program code can determine when the item 100 will become ineffective and provide the user with a warning in advance of this predicted failure time. In some embodiments of the present invention, the program code can utilize an optic sensor 140 in the item 100 of ESD footwear to predict whether the voltage increase is due to dust on the item 100, rather than wear and tear on the shoe. To this end, the program code obtains data from the sensor to determine whether dust is present on the shoe, the program code can utilize this data to assign a dust level to the item 100, wherein certain dust levels would indicate an amount of dust that would impact the efficacy of the item 100 (and account, likely, for the voltage increase). An alert to the user can be adjusted by the program code to reflect the results of this analysis and thus, guide a user in mitigating the issue (240). In embodiments of the present invention, ESD compliance and alerts can be established by means of the computer program and the embedded sensors on the ESD footwear.

An increase in voltage can also indicate a hot spot (worn spot) on an ESD floor. In some embodiments of the present invention, based on monitoring the voltage data, the program code determines that the voltage is increasing (232). For example, based on the monitoring, the program code can determine that the voltage data indicates a rapid voltage increase. The program code obtains location data from a location sensor 170 of the item 100. In some embodiments of the present invention, the program code validates the location of the user by means of a global positioning system, or indoor positioning system, for functionality of the ESD floor, based on monitoring the voltage data from the one or more voltage sensors. Based on obtaining similar increased voltage data at the location (e.g., from additional individuals in a space that includes the ESD floor), the program code determines that the location is a hot spot and thus, need some attention (235). For example, if a wax is used on the ESD floor, the determination of the program code that the location is a hot spot can indicate that the wax needs to be reapplied. If the ESD floor is an epoxy floor, to maintain the floor, the user should check to see if the top coat failed or if there is an issue with a tile floor it, as this hot spot result could indicate a tile failure.

In some embodiments of the present invention, the program code alerts the user of an issue at the location (240). In some embodiments of the present invention, the item 100 of ESD footwear includes a moisture sensor 130, which the program code utilizes to detect whether the ESD floor is damp, which would affect the efficacy of the floor. In addition to providing the program code with moisture data, so that the program code can trigger an alert if the floor is too damp and efficacy is impacted, in the event of a location being identified as a hot spot, the program code can obtain moisture data for this location to determine if the moisture level may be contributing to the issue. If there is an issue with the moisture, the program code can alert the user to this issue and provide this data to assist in mitigation of the issue (240).

Returning to FIG. 2, when the program code determines that the voltage is increasing (232), the program code also determines whether the voltage increase indicates an issue with the item 100, the ESD floor, or both. To this end, the program code determines if the voltage increase is experienced at a particular location of the ESD floor (based on obtaining location data from location sensor 170 of the item 100) or if it remains consistent as the location of the item 100 relative to the location on the floor, changes (234). Based on determining that the voltage change is localized to the location, the program code compares voltage data from additional sensors in ESD items utilized by one or more users at the location (235), and determines whether a similar increase in voltage was noted at the location by the additional sensors (236). Based on identifying a similar increase, the program code determines that the location presents an issue (and likely requires maintenance or replacement) (237). Thus, in embodiments of the present invention, hot spots are effectively crowd-sourced. Based on determining that the voltage change is not localized to the location, the program code determines that the item 100 presents and issue (and likely requires maintenance or replacement) (238). As these possibilities are not mutually exclusive, if the program code determines that the voltage change is not localized to the location, the program code can also obtain data from other users on the ESD floor to determine if the location also requires maintenance (236). Based on determining that there is an issue with one or more of the floor or the item, the program code notifies the user of the issue (240).

In some embodiments of the present invention, the program code continuously monitors the voltage data to collect qualification data for the item 100 and the flooring for compliance verification (230). Based on a consistency in voltage data, unlike in existing systems, no measurements of resistance of the floor or the footwear would be needed, unless the voltage started to increase.

Returning to FIG. 2, when program code determines that the voltage is increasing (232), the determination and what constitutes increased voltage at a level that indicates a failure (or predicts a failure in the future), can be dependent on a wearer of the item 100 walking on the ESD floor. To determine whether a given voltage increase is problematic, program code in embodiments of the present invention applies a predictive analytics function, which can be personalized to the user and/or to conditions of the environment. For example, a gait of a user can affect voltage and can also affect the longevity of the item 100 of ESD footwear worn by the user. As aforementioned, in embodiments of the present invention, the item 100 of ESD footwear can include an accelerometer 180, which the program code utilizes to detect a type of foot motion of the wearer of the item 100 (e.g., dragging of the ESD footwear against a surface, tribocharging, etc.). A gait that includes more dragging would wear out an item 100 faster. Also, this gait could produce voltage spikes based on tribocharging, rather than the voltage spike indicating an equipment failure. Thus, in some embodiments of the present invention, when determining whether a change in voltage indicates an issue with the ESD footwear or floor, the program code can utilize motion data related to the user. Additionally, the program code can predict a failure of the item 100 of ESD footwear based on it being worn by a user who regularly drags the user's feet.

Figure 3:
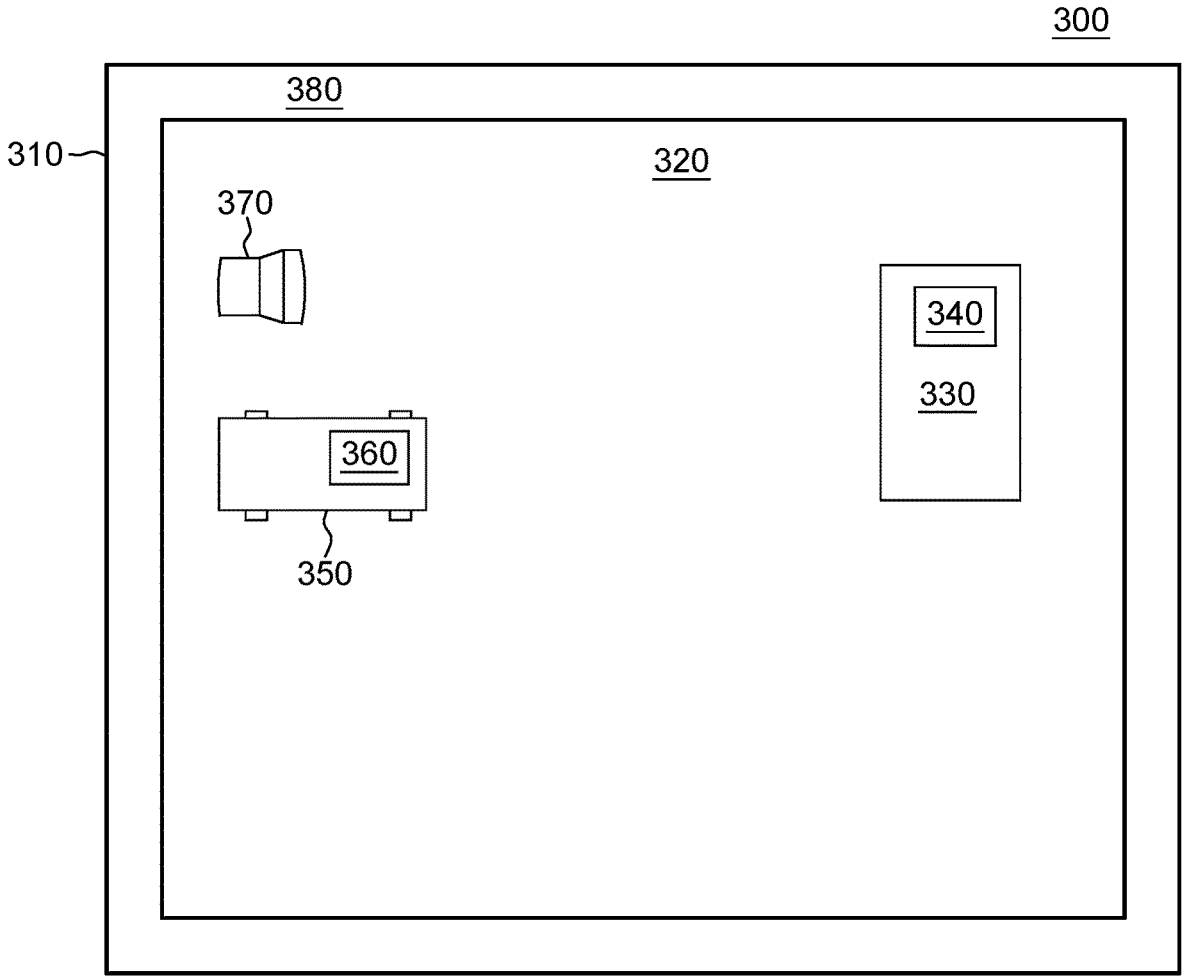
FIG. 3 is an illustration of various aspects of an environment into which aspects of embodiments of the present invention may be implemented.

FIG. 3 is an example of a technical environment 300 into which aspects of the present invention can be implemented. A physical space 310 includes an ESD floor 320, upon which at least one user wearing ESD footwear 330 is standing or moving. The ESD footwear 330 includes various sensors 340, which are communicatively coupled to a computing resource 350 executing program code 360. A display 370 is coupled to the computing resource 350 such that the executing program code 360 can provide alerts on the display 370. Although the computing resource 350 is pictured as being located in the physical space 310, provided that communications are available over a network between the sensors 340 and the computing resource 350, the computing resource 350 can be at a location remote from the physical space 310. The computing resource 350 can be one or more computing resources and may include resources of a cloud computing system. To prevent the at least one user wearing ESD footwear 330 from leaving the physical environment 300 without changing footwear, one of more sensors 380 are placed around a perimeter of the ESD floor 320, forming a geo-fence. The program code 360 receives alerts from the sensors 380 and displays these alerts on the display 370 in order to prevent the at least one user wearing ESD footwear 330 from leaving the physical environment 300 without changing footwear, by alerting the at least one user that the user is crossing a perimeter while still wearing the ESD footwear 330 (as indicated by the sensor indicating an exit and the program code obtaining data from a pressure sensor of the sensors 340 in the ESD footwear 330 indicating a threshold level of pressure for a defined period of time). The size and shape of the physical space 310 in FIG. 3 is provided as an example and is for illustrative purposes only and does not impose any limitations.

Embodiments of the present invention include a computer-implemented method, a computer program product, and a computer system where program code executing on one or more processors continuously obtains pressure data from one or more pressure sensors embedded in one or more items of electrostatic dissipative (ESD) footwear, the one or more items of ESD footwear each comprising a sole. The program code determines that the obtained pressure data indicates a pressure level of a pre-determined threshold and the given threshold is sustained for a pre-determined interval of time in a portion of items of the one or more items. Based on the determining, the program code accesses one or more voltage sensors embedded in each item of the portion of items and obtaining voltage data from the one or more voltage sensors, where the obtaining comprises utilizing an ESD floor as a ground reference, and where one or more soles of the portion of the items are in contact with the ESD floor during the obtaining. The program code validates functionality of the portion of the items and functionality of the ESD floor, based on monitoring the voltage data from the one or more voltage sensors. In some embodiments of the present invention, the program code validates by determining that the voltage data is within an expected range.

In some embodiments of the present invention, the program code identifies, based on the voltage data, an increase in voltage from at least one item of the portion of items. Based in the increase in voltage, the program code transmits a notification of a performance issue with at least one item. The program code can determine a cause of the performance issue, where the cause is selected from the group consisting of: wear on the at least one item and debris on the at least one item. In some embodiments of the present invention the cause of the performance issue is the debris on the at least one item, and the program code determined the cause is the debris by obtaining, from an optic sensor embedded in the at least one item, an indication of presence of the debris. In some embodiments of the present invention, the cause of the performance issue is wear on the at least one item, and the program code determined that the cause is the wear by obtaining, from an accelerometer embedded in the item, motion of the item, and determining that the motion comprises dragging of the at least one item against a surface.

In some embodiments of the present invention, the program code identifies, based on the voltage data, an increase in voltage from at least one item of the portion of items. The program code obtains, from a location device embedded in the at least one item, a location of the at least one item, the location comprising global positioning system coordinates. The program code identifies a position on the ESD floor located at the global positioning system coordinates. The program code determines, based on monitoring the one or more voltage sensors of the portion of items, if each item of the portion of the items comprising a remainder of the one or more voltage sensors emits voltage data indicating an increase in voltage similar to the increase in voltage, when each item is located on the position on the ESD floor, where the remainder of the one or more voltage sensors comprise one or more voltage sensors associated with items in the portion that are not the at least one item. In some embodiments of the present invention, based on determining that a threshold number of the remainder of the one or more voltage sensors indicate the similar increase in voltage, the program code transmits an alert to indicate a performance issue at the position. The alert can comprise a cause for the performance issue and the program code can obtain, from a moisture sensor embedded in the at least one item, when the at least one item is on the position, a moisture level and determine that the moisture level is the cause for the performance issue.

In some embodiments of the present invention, the program code identifies, based on the voltage data, an initial increase in voltage from at least one item of the portion of items. The program code obtains, from a location device embedded in the at least one item, a first location of the at least one item, the first location comprising a first set of coordinates, where the first set of coordinates are selected from the group consisting of: global positioning system coordinates or indoor positioning system coordinates. The program code identifies a first position on the ESD floor located at the first set of coordinates. The program code identifies, based on the voltage data, a continued increase in voltage from at least one item of the portion of items. The program code obtains, from the location device embedded in the at least one item, a second location of the at least one item, the second location comprising a second set coordinates, where the second set of coordinates are selected from the group consisting of: global positioning system coordinates or indoor positioning system coordinates. The program code identifies a second position on the ESD floor located at the second set of coordinates. The program code transmits a notification of a performance issue with at least one item.

Some embodiments of the present invention include an item of electrostatic dissipative (ESD) footwear in communication with one or more processors, the item includes: a sole in continuous contact with an ESD floor, one or more pressure sensors, and one or more voltage sensors.

Referring now to FIG. 4, a schematic of an example of a computing node, which can be a cloud computing node 10. Cloud computing node 10 is only one example of a suitable cloud computing node and is not intended to suggest any limitation as to the scope of use or functionality of embodiments of the invention described herein. Regardless, cloud computing node 10 is capable of being implemented and/or performing any of the functionality set forth hereinabove. In an embodiment of the present invention computing resource 350 (FIG. 3) can each be understood as a cloud computing node 10 (FIG. 4) and if not a cloud computing node 10, then one or more general computing nodes that include aspects of the cloud computing node 10. Various examples of these resources may, together, comprise a hybrid cloud.

In cloud computing node 10 there is a computer system/server 12, which is operational with numerous other general purpose or special purpose computing system environments or configurations. Examples of well-known computing systems, environments, and/or configurations that may be suitable for use with computer system/server 12 include, but are not limited to, personal computer systems, server computer systems, thin clients, thick clients, handheld or laptop devices, multiprocessor systems, microprocessor-based systems, set top boxes, programmable consumer electronics, network PCs, minicomputer systems, mainframe computer systems, and distributed cloud computing environments that include any of the above systems or devices, and the like.

Computer system/server 12 may be described in the general context of computer system-executable instructions, such as program modules, being executed by a computer system. Generally, program modules may include routines, programs, objects, components, logic, data structures, and so on that perform particular tasks or implement particular abstract data types. Computer system/server 12 may be practiced in distributed cloud computing environments where tasks are performed by remote processing devices that are linked through a communications network. In a distributed cloud computing environment, program modules may be located in both local and remote computer system storage media including memory storage devices.

As shown in FIG. 4, computer system/server 12 that can be utilized as cloud computing node 10 is shown in the form of a general-purpose computing device. The components of computer system/server 12 may include, but are not limited to, one or more processors or processing units 16, a system memory 28, and a bus 18 that couples various system components including system memory 28 to processor 16.

Bus 18 represents one or more of any of several types of bus structures, including a memory bus or memory controller, a peripheral bus, an accelerated graphics port, and a processor or local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnect (PCI) bus.

Computer system/server 12 typically includes a variety of computer system readable media. Such media may be any available media that is accessible by computer system/server 12, and it includes both volatile and non-volatile media, removable and non-removable media.

System memory 28 can include computer system readable media in the form of volatile memory, such as random access memory (RAM) 30 and/or cache memory 32. Computer system/server 12 may further include other removable/non-removable, volatile/non-volatile computer system storage media. By way of example only, storage system 34 can be provided for reading from and writing to a non-removable, non-volatile magnetic media (not shown and typically called a "hard drive"). Although not shown, a magnetic disk drive for reading from and writing to a removable, non-volatile magnetic disk (e.g., a "floppy disk"), and an optical disk drive for reading from or writing to a removable, non-volatile optical disk such as a CD-ROM, DVD-ROM or other optical media can be provided. In such instances, each can be connected to bus 18 by one or more data media interfaces. As will be further depicted and described below, memory 28 may include at least one program product having a set (e.g., at least one) of program modules that are configured to carry out the functions of embodiments of the invention.

Program/utility 40, having a set (at least one) of program modules 42, may be stored in memory 28 by way of example, and not limitation, as well as an operating system, one or more application programs, other program modules, and program data. Each of the operating system, one or more application programs, other program modules, and program data or some combination thereof, may include an implementation of a networking environment. Program modules 42 generally carry out the functions and/or methodologies of embodiments of the invention as described herein.

Computer system/server 12 may also communicate with one or more external devices 14 such as a keyboard, a pointing device, a display 24, etc.; one or more devices that enable a user to interact with computer system/server 12; and/or any devices (e.g., network card, modem, etc.) that enable computer system/server 12 to communicate with one or more other computing devices. Such communication can occur via Input/Output (I/O) interfaces 22. Still yet, computer system/server 12 can communicate with one or more networks such as a local area network (LAN), a general wide area network (WAN), and/or a public network (e.g., the Internet) via network adapter 20. As depicted, network adapter 20 communicates with the other components of computer system/server 12 via bus 18. It should be understood that although not shown, other hardware and/or software components could be used in conjunction with computer system/server 12. Examples include, but are not limited to: microcode, device drivers, redundant processing units, external disk drive arrays, RAID systems, tape drives, and data archival storage systems, etc.

It is to be understood that although this disclosure includes a detailed description on cloud computing, implementation of the teachings recited herein are not limited to a cloud computing environment. Rather, embodiments of the present invention are capable of being implemented in conjunction with any other type of computing environment now known or later developed.

Cloud computing is a model of service delivery for enabling convenient, on-demand network access to a shared pool of configurable computing resources (e.g., networks, network bandwidth, servers, processing, memory, storage, applications, virtual machines, and services) that can be rapidly provisioned and released with minimal management effort or interaction with a provider of the service. This cloud model may include at least five characteristics, at least three service models, and at least four deployment models.

Characteristics are as follows:

On-demand self-service: a cloud consumer can unilaterally provision computing capabilities, such as server time and network storage, as needed automatically without requiring human interaction with the service's provider.

Broad network access: capabilities are available over a network and accessed through standard mechanisms that promote use by heterogeneous thin or thick client platforms (e.g., mobile phones, laptops, and PDAs). Resource pooling: the provider's computing resources are pooled to serve multiple consumers using a multi-tenant model, with different physical and virtual resources dynamically assigned and reassigned according to demand. There is a sense of location independence in that the consumer generally has no control or knowledge over the exact location of the provided resources but may be able to specify location at a higher level of abstraction (e.g., country, state, or datacenter). Rapid elasticity: capabilities can be rapidly and elastically provisioned, in some cases automatically, to quickly scale out and rapidly released to quickly scale in. To the consumer, the capabilities available for provisioning often appear to be unlimited and can be purchased in any quantity at any time.

Measured service: cloud systems automatically control and optimize resource use by leveraging a metering capability at some level of abstraction appropriate to the type of service (e.g., storage, processing, bandwidth, and active user accounts). Resource usage can be monitored, controlled, and reported, providing transparency for both the provider and consumer of the utilized service.

Service Models are as follows:

Software as a Service (SaaS): the capability provided to the consumer is to use the provider's applications running on a cloud infrastructure. The applications are accessible from various client devices through a thin client interface such as a web browser (e.g., web-based e-mail). The consumer does not manage or control the underlying cloud infrastructure including network, servers, operating systems, storage, or even individual application capabilities, with the possible exception of limited user specific application configuration settings.

Platform as a Service (PaaS): the capability provided to the consumer is to deploy onto the cloud infrastructure consumer-created or acquired applications created using programming languages and tools supported by the provider. The consumer does not manage or control the underlying cloud infrastructure including networks, servers, operating systems, or storage, but has control over the deployed applications and possibly application hosting environment configurations.

Infrastructure as a Service (IaaS): the capability provided to the consumer is to provision processing, storage, networks, and other fundamental computing resources where the consumer is able to deploy and run arbitrary software, which can include operating systems and applications. The consumer does not manage or control the underlying cloud infrastructure but has control over operating systems, storage, deployed applications, and possibly limited control of select networking components (e.g., host firewalls).

Deployment Models are as follows:

Private cloud: the cloud infrastructure is operated solely for an organization. It may be managed by the organization or a third party and may exist on-premises or off premises.

Community cloud: the cloud infrastructure is shared by several organizations and supports a specific community that has shared concerns (e.g., mission, security requirements, policy, and compliance considerations). It may be managed by the organizations or a third party and may exist on-premises or off-premises.

Public cloud: the cloud infrastructure is made available to the general public or a large industry group and is owned by an organization selling cloud services.

Hybrid cloud: the cloud infrastructure is a composition of two or more clouds (private, community, or public) that remain unique entities but are bound together by standardized or proprietary technology that enables data and application portability (e.g., cloud bursting for load-balancing between clouds).

A cloud computing environment is service oriented with a focus on statelessness, low coupling, modularity, and semantic interoperability. At the heart of cloud computing is an infrastructure that includes a network of interconnected nodes.

Figure 5:
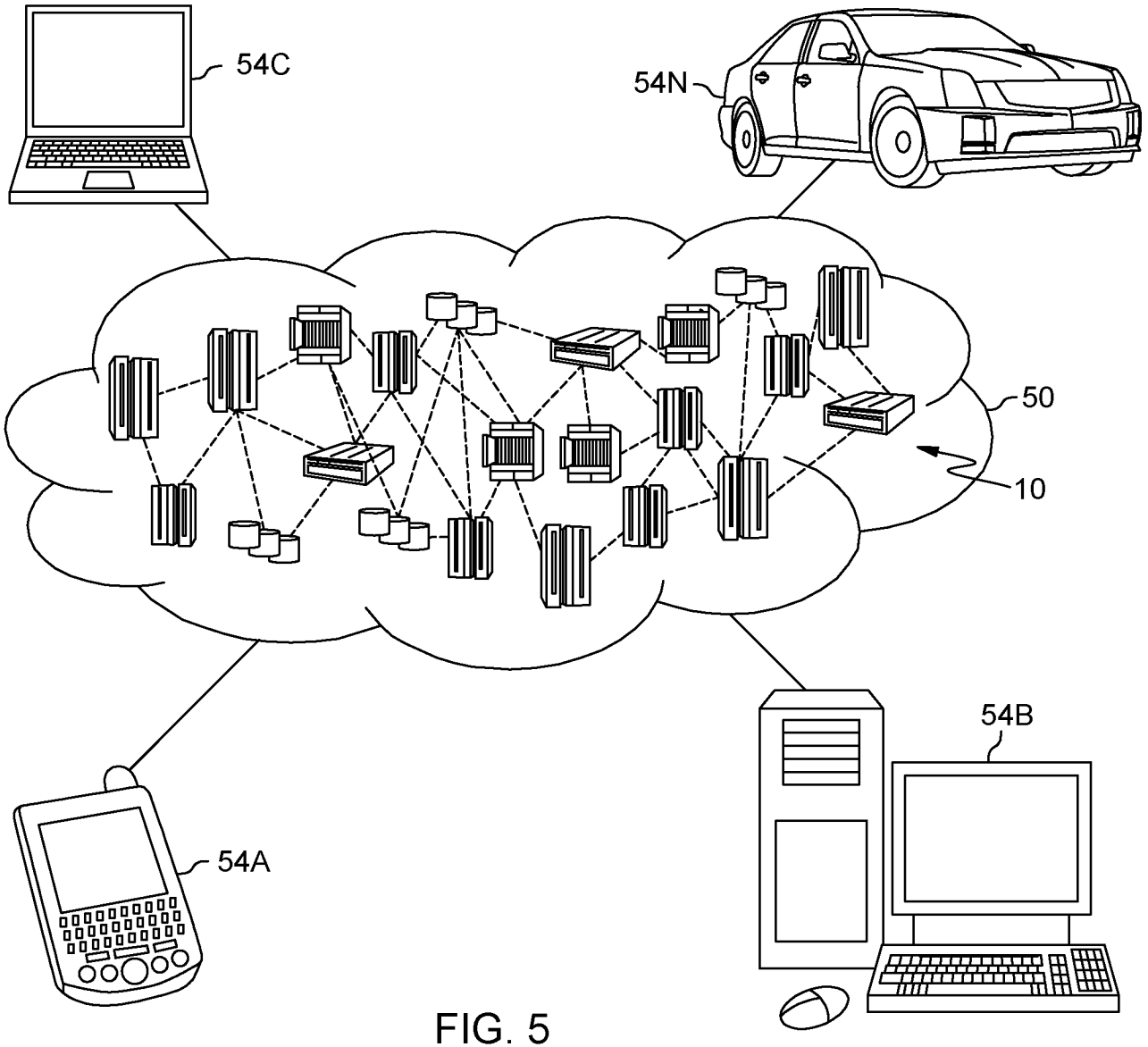
FIG. 5 depicts a cloud computing environment according to an embodiment of the present invention.

Referring now to FIG. 5, illustrative cloud computing environment 50 is depicted. As shown, cloud computing environment 50 includes one or more cloud computing nodes 10 with which local computing devices used by cloud consumers, such as, for example, personal digital assistant (PDA) or cellular telephone 54A, desktop computer 54B, laptop computer 54C, and/or automobile computer system 54N may communicate. Nodes 10 may communicate with one another. They may be grouped (not shown) physically or virtually, in one or more networks, such as Private, Community, Public, or Hybrid clouds as described hereinabove, or a combination thereof. This allows cloud computing environment 50 to offer infrastructure, platforms and/or software as services for which a cloud consumer does not need to maintain resources on a local computing device. It is understood that the types of computing devices 54A-N shown in FIG. 5 are intended to be illustrative only and that computing nodes 10 and cloud computing environment 50 can communicate with any type of computerized device over any type of network and/or network addressable connection (e.g., using a web browser).

Figure 6:
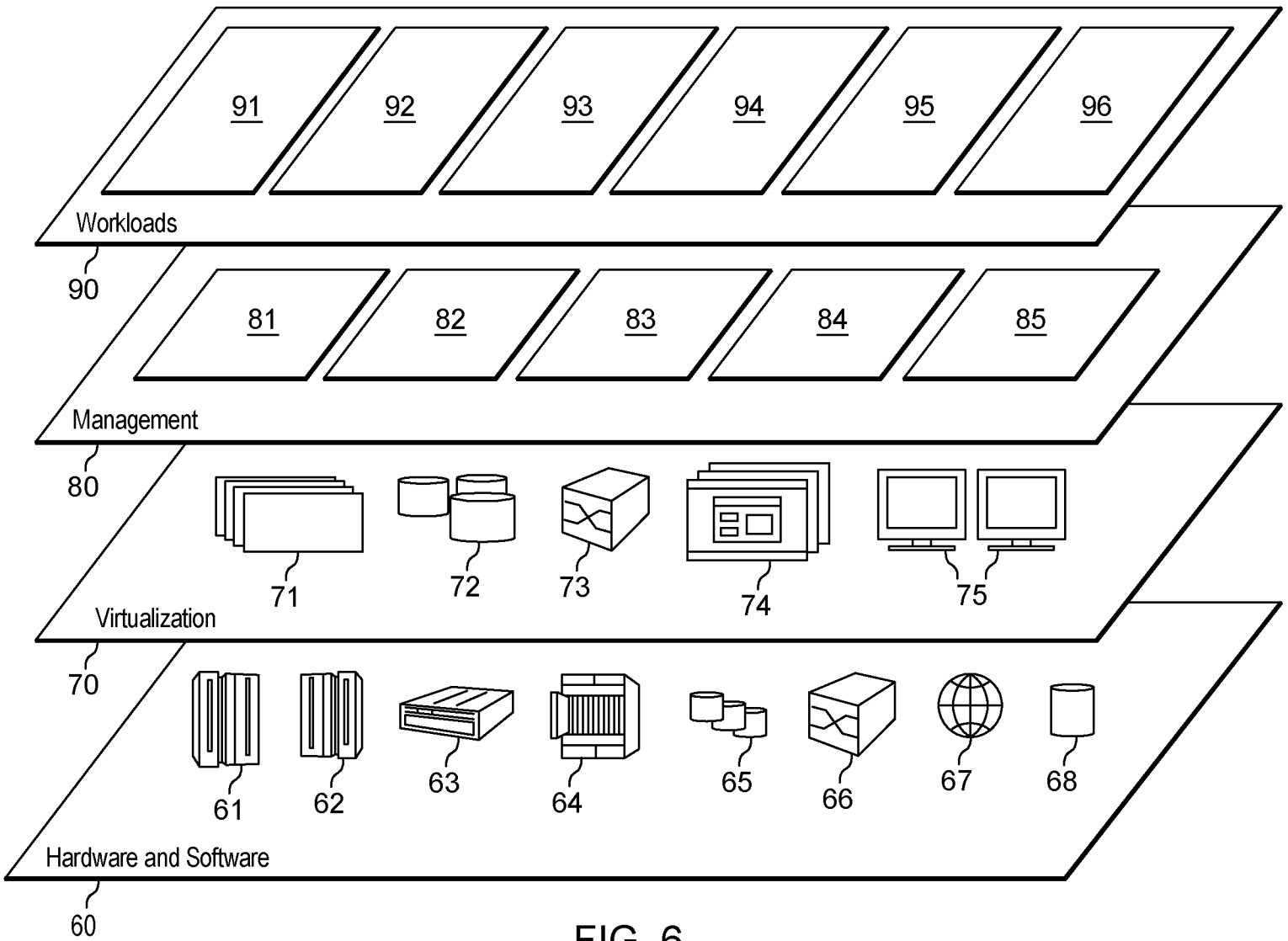
FIG. 6 depicts abstraction model layers according to an embodiment of the present invention.

Referring now to FIG. 6, a set of functional abstraction layers provided by cloud computing environment 50 (FIG. 5) is shown. It should be understood in advance that the components, layers, and functions shown in FIG. 6 are intended to be illustrative only and embodiments of the invention are not limited thereto. As depicted, the following layers and corresponding functions are provided:

Hardware and software layer 60 includes hardware and software components. Examples of hardware components include: mainframes 61; RISC (Reduced Instruction Set Computer) architecture based servers 62; servers 63; blade servers 64; storage devices 65; and networks and networking components 66. In some embodiments, software components include network application server software 67 and database software 68.

Virtualization layer 70 provides an abstraction layer from which the following examples of virtual entities may be provided: virtual servers 71; virtual storage 72; virtual networks 73, including virtual private networks; virtual applications and operating systems 74; and virtual clients 75.

In one example, management layer 80 may provide the functions described below. Resource provisioning 81 provides dynamic procurement of computing resources and other resources that are utilized to perform tasks within the cloud computing environment. Metering and Pricing 82 provide cost tracking as resources are utilized within the cloud computing environment, and billing or invoicing for consumption of these resources. In one example, these resources may include application software licenses. Security provides identity verification for cloud consumers and tasks, as well as protection for data and other resources. User portal 83 provides access to the cloud computing environment for consumers and system administrators. Service level management 84 provides cloud computing resource allocation and management such that required service levels are met. Service Level Agreement (SLA) planning and fulfillment 85 provide pre-arrangement for, and procurement of, cloud computing resources for which a future requirement is anticipated in accordance with an SLA.

Workloads layer 90 provides examples of functionality for which the cloud computing environment may be utilized. Examples of workloads and functions which may be provided from this layer include: mapping and navigation 91; software development and lifecycle management 92; virtual classroom education delivery 93; data analytics processing 94; transaction processing 95; and predicting possible issues with ESD environments and items 96.

The present invention may be a system, a method, and/or a computer program product at any possible technical detail level of integration. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, configuration data for integrated circuitry, or either source code or object code written in any combination of one or more programming languages, including an object oriented programming language such as Smalltalk, C++, or the like, and procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the blocks may occur out of the order noted in the Figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

The terminology used herein is for the purpose of describing particular embodiments only and is not intended to be limiting. As used herein, the singular forms "a", "an" and "the" are intended to include the plural forms as well, unless the context clearly indicates otherwise. It will be further understood that the terms "comprises" and/or "comprising", when used in this specification, specify the presence of stated features, integers, steps, operations, elements, and/or components, but do not preclude the presence or addition of one or more other features, integers, steps, operations, elements, components and/or groups thereof.

The corresponding structures, materials, acts, and equivalents of all means or step plus function elements in the claims below, if any, are intended to include any structure, material, or act for performing the function in combination with other claimed elements as specifically claimed. The description of one or more embodiments has been presented for purposes of illustration and description, but is not intended to be exhaustive or limited to in the form disclosed. Many modifications and variations will be apparent to those of ordinary skill in the art. The embodiment was chosen and described in order to best explain various aspects and the practical application, and to enable others of ordinary skill in the art to understand various embodiments with various modifications as are suited to the particular use contemplated.

What is claimed is:

1. A computer-implemented method, comprising:

continuously obtaining, by one or more processors, pressure data from one or more pressure sensors embedded in one or more items of electrostatic dissipative (ESD) footwear, the one or more items of ESD footwear each comprising a sole;

determining, by the one or more processors, that the obtained pressure data indicates a pressure level of a pre-determined threshold and the given threshold is sustained for a pre-determined interval of time in a portion of items of the one or more items;

based on the determining, accessing, by the one or more processors, one or more voltage sensors embedded in each item of the portion of items and obtaining voltage data from the one or more voltage sensors, wherein the obtaining comprises utilizing an ESD floor as a ground reference, and wherein one or more soles of the portion of the items are in contact with the ESD floor during the obtaining; and validating, by the one or more processors, functionality of the portion of the items and functionality of the ESD floor, based on monitoring the voltage data from the one or more voltage sensors.

2. The computer-implemented method of claim 1, wherein the validating further comprises:

determining, by the one or more processors, that the voltage data is within an expected range.

3. The computer-implemented method of claim 1, further comprising:

identifying, by the one or more processors, based on the voltage data, an increase in voltage from at least one item of the portion of items; and based in the increase in voltage, transmitting, by the one or more processors, a notification of a performance issue with at least one item.

4. The computer-implemented method of claim 3, further comprising:

determining, by the one or more processors, a cause of the performance issue, wherein the cause is selected from the group consisting of: wear on the at least one item and debris on the at least one item.

5. The computer-implemented method of claim 4, wherein the cause of the performance issue is the debris on the at least one item, and wherein determining that the cause is the debris comprises:

obtaining, by the one or more processors, from an optic sensor embedded in the at least one item, an indication of presence of the debris.

6. The computer-implemented method of claim 4, wherein the cause of the performance issue is wear on the at least one item, and wherein determining that the cause is the wear comprises:

obtaining, by the one or more processors, from an accelerometer embedded in the item, motion of the item; and determining, by the one or more processors, that the motion comprises dragging of the at least one item against a surface.

7. The computer-implemented method of claim 1, further comprising:

identifying, by the one or more processors, based on the voltage data, an increase in voltage from at least one item of the portion of items;

obtaining, by the one or more processors, from a location device embedded in the at least one item, a location of the at least one item, the location comprising global positioning system coordinates;

identifying, by the one or more processors, a position on the ESD floor located at the global positioning system coordinates; and determining, by the one or more processors, based on monitoring the one or more voltage sensors of the portion of items, if each item of the portion of the items comprising a remainder of the one or more voltage sensors emits voltage data indicating an increase in voltage similar to the increase in voltage, when each item is located on the position on the ESD floor, wherein the remainder of the one or more voltage sensors comprise one or more voltage sensors associated with items in the portion that are not the at least one item.

8. The computer-implemented method of claim 7, further comprising:

based on determining that a threshold number of the remainder of the one or more voltage sensors indicate the similar increase in voltage, transmitting, by the one or more processors, an alert to indicate a performance issue at the position.

9. The computer-implemented method of claim 8, wherein the alert comprises a cause for the performance issue, the method further comprising:

obtaining, by the one or more processors, from a moisture sensor embedded in the at least one item, when the at least one item is on the position, a moisture level; and determining, by the one or more processors, that the moisture level is the cause for the performance issue.

10. The computer-implemented method of claim 1, further comprising:

identifying, by the one or more processors, based on the voltage data, an initial increase in voltage from at least one item of the portion of items;

obtaining, by the one or more processors, from a location device embedded in the at least one item, a first location of the at least one item, the first location comprising a first set of coordinates, wherein the first set of coordinates are selected from the group consisting of: global positioning system coordinates or indoor positioning system coordinates;

identifying, by the one or more processors, a first position on the ESD floor located at the first set of coordinates;

identifying, by the one or more processors, based on the voltage data, a continued increase in voltage from at least one item of the portion of items;

obtaining, by the one or more processors, from the location device embedded in the at least one item, a second location of the at least one item, the second location comprising a second set coordinates, wherein the second set of coordinates are selected from the group consisting of: global positioning system coordinates or indoor positioning system coordinates;

identifying, by the one or more processors, a second position on the ESD floor located at the second set of coordinates; and transmitting, by the one or more processors, a notification of a performance issue with at least one item.

11. A system comprising:

a memory;

one or more processors in communication with the memory; and program instructions executable by the one or more processors via the memory to perform a method, the method comprising:

continuously obtaining, by the one or more processors, pressure data from one or more pressure sensors embedded in one or more items of electrostatic dissipative (ESD) footwear, the one or more items of ESD footwear each comprising a sole;

determining, by the one or more processors, that the obtained pressure data indicates a pressure level of a pre-determined threshold and the given threshold is sustained for a pre-determined interval of time in a portion of items of the one or more items;

based on the determining, accessing, by the one or more processors, one or more voltage sensors embedded in each item of the portion of items and obtaining voltage data from the one or more voltage sensors, wherein the obtaining comprises utilizing an ESD floor as a ground reference, and wherein one or more soles of the portion of the items are in contact with the ESD floor during the obtaining; and validating, by the one or more processors, functionality of the portion of the items and functionality of the ESD floor, based on monitoring the voltage data from the one or more voltage sensors.

12. The system of claim 11, wherein the validating further comprises:

determining, by the one or more processors, that the voltage data is within an expected range.

13. The system of claim 11, the method further comprising:

identifying, by the one or more processors, based on the voltage data, an increase in voltage from at least one item of the portion of items; and based in the increase in voltage, transmitting, by the one or more processors, a notification of a performance issue with at least one item.

14. The system of claim 13, the method further comprising:

determining, by the one or more processors, a cause of the performance issue, wherein the cause is selected from the group consisting of: wear on the at least one item and debris on the at least one item.

15. The system of claim 14, wherein the cause of the performance issue is the debris on the at least on item and determining that the cause is the debris comprises:

obtaining, by the one or more processors, from an optic sensor embedded in the at least one item, an indication of presence of the debris.

16. The system of claim 14, wherein the cause of the performance issue is wear on the at least one item and determining that the cause is the wear comprises:

obtaining, by the one or more processors, from an accelerometer embedded in the item, motion of the item; and determining, by the one or more processors, that the motion comprises dragging of the at least one item against a surface.

17. The system of claim 11, the method further comprising:

identifying, by the one or more processors, based on the voltage data, an increase in voltage from at least one item of the portion of items;

obtaining, by the one or more processors, from a location device embedded in the at least one item, a location of the at least one item, the location comprising global positioning system coordinates;

identifying, by the one or more processors, a position on the ESD floor located at the global positioning system coordinates; and determining, by the one or more processors, based on monitoring the one or more voltage sensors of the portion of items, if each item of the portion of the items comprising a remainder of the one or more voltage sensors emits voltage data indicating an increase in voltage similar to the increase in voltage, when each item is located on the position on the ESD floor, wherein the remainder of the one or more voltage sensors comprise one or more voltage sensors associated with items in the portion that are not the at least one item.

18. A computer program product comprising:

a non-transitory computer readable storage medium readable by one or more processors and storing instructions for execution by the one or more processors for performing a method comprising:

continuously obtaining, by one or more processors, pressure data from one or more pressure sensors embedded in one or more items of electrostatic dissipative (ESD) footwear, the one or more items of ESD footwear each comprising a sole;

determining, by the one or more processors, that the obtained pressure data indicates a pressure level of a pre-determined threshold and the given threshold is sustained for a pre-determined interval of time in a portion of items of the one or more items;

based on the determining, accessing, by the one or more processors, one or more voltage sensors embedded in each item of the portion of items and obtaining voltage data from the one or more voltage sensors, wherein the obtaining comprises utilizing an ESD floor as a ground reference, and wherein one or more soles of the portion of the items are in contact with the ESD floor during the obtaining; and validating, by the one or more processors, functionality of the portion of the items and functionality of the ESD floor, based on monitoring the voltage data from the one or more voltage sensors.

19. The computer program product of claim 18, wherein the validating further comprises:

determining, by the one or more processors, that the voltage data is within an expected range.

20. The computer program product of claim 18, the method further comprising:

identifying, by the one or more processors, based on the voltage data, an increase in voltage from at least one item of the portion of items; and based in the increase in voltage, transmitting, by the one or more processors, a notification of a performance issue with at least one item.

* * * * *